US006644155B2

(12) United States Patent
Phelps et al.

(10) Patent No.: US 6,644,155 B2
(45) Date of Patent: Nov. 11, 2003

(54) ROLL PRODUCT DISPENSER WITH IMPROVED CUTTING MECHANISM

(75) Inventors: Stephen L. Phelps, Lilburn, GA (US); Paul F. Tramontina, Alpharetta, GA (US); Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 104 days.

(21) Appl. No.: 09/741,499

(22) Filed: Dec. 19, 2000

(65) Prior Publication Data

US 2002/0073819 A1 Jun. 20, 2002

(51) Int. Cl.[7] ..... A47K 10/36; B26D 1/62; B26D 5/14

(52) U.S. Cl. ..... 83/339; 83/297; 83/550; 83/594; 83/649

(58) Field of Search ..... 83/298, 339, 594, 83/649, 296, 297, 285, 334, 335, 346, 550, 602, 604

(56) References Cited

U.S. PATENT DOCUMENTS

| | | | | | |
|---|---|---|---|---|---|
| 195,823 | A | * | 10/1877 | Jaeger | 83/339 X |
| 1,336,605 | A | * | 4/1920 | Becker | 83/285 X |
| 1,543,299 | A | * | 6/1925 | Shelley | 83/334 |
| 1,553,331 | A | * | 9/1925 | Shelley | 83/334 |
| 2,051,242 | A | * | 8/1936 | Birr et al. | 83/339 X |
| 2,274,623 | A | * | 2/1942 | Hawkins | 83/339 X |
| RE28,911 | E | * | 7/1976 | Jespersen et al. | 83/334 X |
| 3,998,120 | A | * | 12/1976 | Granger et al. | 83/335 |
| 4,213,363 | A | * | 7/1980 | Granger | 83/298 |
| 4,307,638 | A | * | 12/1981 | DeLuca et al. | 83/335 X |
| 4,307,639 | A | | 12/1981 | DeLuca | |
| 4,404,880 | A | | 9/1983 | DeLuca | |
| 4,488,466 | A | | 12/1984 | Jones | |
| 4,608,894 | A | * | 9/1986 | Lee et al. | 83/649 X |
| 4,621,755 | A | | 11/1986 | Granger | |
| 4,712,461 | A | | 12/1987 | Rasmussen | |
| 4,846,035 | A | | 7/1989 | Granger | |
| 4,856,397 | A | * | 8/1989 | Rebekale | 83/339 X |
| 4,943,341 | A | | 7/1990 | Mattei | |
| 5,000,069 | A | | 3/1991 | Knobel | |
| 5,146,830 | A | | 9/1992 | Granger | |
| 5,359,915 | A | | 11/1994 | Hitz | |
| 5,647,261 | A | | 7/1997 | Wierenga | |
| 5,692,440 | A | | 12/1997 | Hillebrand | |
| 5,826,479 | A | | 10/1998 | Suzuki et al. | |
| 5,979,062 | A | | 11/1999 | Prosan | |
| 6,112,631 | A | * | 9/2000 | VanAlstine | 83/339 X |

* cited by examiner

*Primary Examiner*—Charles Goodman
(74) *Attorney, Agent, or Firm*—Dority & Manning

(57) ABSTRACT

An apparatus for dispensing and cutting measured amounts from a roll of web material includes a roll carrier disposed within a housing. A rotatable drum is disposed proximate to the roll carrier, with the roll carrier being biased towards the drum so that the web material carried by the roll carrier is frictionally engaged against the drum. The drum thus rotates upon a free end of the web material being pulled from the housing. The cutting mechanism is movably mounted within the housing external of the rotatable drum. The cutting mechanism is engaged by the drum along a portion of the rotational arc of the drum and is moved by the drum to a cutting position wherein a blade carried by the cutting mechanism moves across the conveying path of the web material and cuts the web material.

18 Claims, 2 Drawing Sheets

ROLL PRODUCT DISPENSER WITH IMPROVED CUTTING MECHANISM

BACKGROUND OF THE INVENTION

The present invention relates to a dispenser for a roll of material, and particularly to a sanitary dispenser that automatically cuts and dispenses a measured amount of material upon a user grasping and pulling the tail end of the roll material.

A number of dispensing devices are well known in the art for dispensing and cutting webs of roll material, including paper toweling, paper products, and the like. With such dispensers, the processes of dispensing and cutting the web material are carried out automatically by pulling on the free or "tail" end of the web material that extends from the apparatus. The web material is engaged against a "rough" or friction enhancing surface of a feed drum and the action of pulling the web material causes the drum to rotate. The drum includes a drive mechanism and, after the initial pull on the web material by the user, the drum is driven a predetermined rotational degree to dispense a metered amount of the web material. These type of dispensers are commonly referred to as "sanitary" dispensers because the user does not manually operate any portion of the drive or cutting mechanism. The user only touches the tail end of the web material that is dispensed and cut for that particular user.

A number of conventional sanitary dispensers also incorporate an additional "stub" roll feature. When the primary roll of web material becomes depleted to a certain extent, it can be placed on a stub roll carrier so that a new primary roll may be loaded into the dispenser. The web material from the stub roll is then fed through the dispensing device with the web material from the primary roll and the two web materials are simultaneously dispensed until the stub roll is completely depleted.

Examples of the conventional dispensers include a line of sanitary dispensers from Kimberly Clark Corporation referred to as SaniTouch® dispensers, the "No Touch" dispensers, and the "Hands-Free" dispensers.

With the conventional dispensers, the feed drum is equipped with a cutting tool, such as a bar, blade, or the like, which extends from a retracted position within the drum to an extended position once the drum reaches a predetermined rotational position to affect a cutting of the web material. Dispensing devices of this type are described in detail in U.S. Pat. Nos. 4,213,363; 4,635,837; 4,621,755; 4,846,035; and 4,122,738. The cutting mechanisms mounted within the drum are, however, relatively complicated and expensive to manufacture and maintain. The drum mounted cutting devices also add significantly to the cost of the drum.

The present invention relates to an improvement in the conventional sanitary dispensers, particularly to an improved cutting mechanism.

SUMMARY OF THE INVENTION

Objects and advantages of the invention will be set forth in the following description, or may be learned from the description or through practice of the invention.

The present invention includes an apparatus for automatically dispensing and cutting measured amounts of material from a roll of web material. The invention utilizes a "sanitary" automatic feeding mechanism known from conventional dispensers, as discussed in the BACKGROUND SECTION.

The apparatus includes a housing in which the internal components of the apparatus are disposed. A roll carrier is disposed within the housing to rotationally carry a primary roll of web material. The housing may also include a stub roll carrier to rotationally carry a partially depleted second web of roll material. The second roll of material may be dispensed with the first web until the second roll is exhausted.

A rotatable feed drum is disposed within the housing proximate to the roll carrier. The roll carrier is biased towards the rotatable drum so that the roll of web material carried by the roll carrier is urged towards the drum. In this way, the web material is frictionally engaged against the drum so as to rotate the drum upon the "tail" or free end of the web material being pulled from the housing.

A cutting mechanism is movably mounted within the housing external of the rotatable drum. The cutting mechanism is engaged by the rotatable drum along a portion of the rotational arc of the drum. A radially extending lever arm may be rotationally fixed at the end of the rotatable drum for this purpose. The cutting mechanism is moved by the rotatable drum along a cutting path that is adjacent to a conveying path of the web material within the housing. The cutting mechanism includes a cutting blade that moves across the conveying path of the material as the cutting mechanism is moved by the rotatable drum to automatically cut the web material. Once the material has been cut, any manner of known feeding mechanism, such as an eccentric spring mechanism, causes the rotatable drum to continue to rotate to its neutral position and dispense a free end or tail of the web material out of the housing.

In one particular embodiment of the invention, the cutting mechanism moves along a linear cutting path within the housing. With this embodiment, the cutting mechanism may include a carriage slidably mounted within the housing, for example to a vertical wall or structure of the housing. A cutting blade holder may be movably mounted to the carriage and carries a cutting blade that extends the width of the web material. The blade holder moves in a direction towards and across the conveying path of the web material as the carriage moves along its linear path. A cam member, such as a ramped surface, may be disposed along the linear path of the carriage to contact and move the blade holder for this purpose.

The carriage may be spring biased to a neutral position within the housing and automatically returns to this position after the web material has been cut. For example, the carriage may be disengaged by the rotatable drum just after the material has been cut, wherein the carriage is then free to return to its neutral position.

The invention will be explained in greater detail below through use of the appended figures.

DETAILED DESCRIPTION

Figure 1:
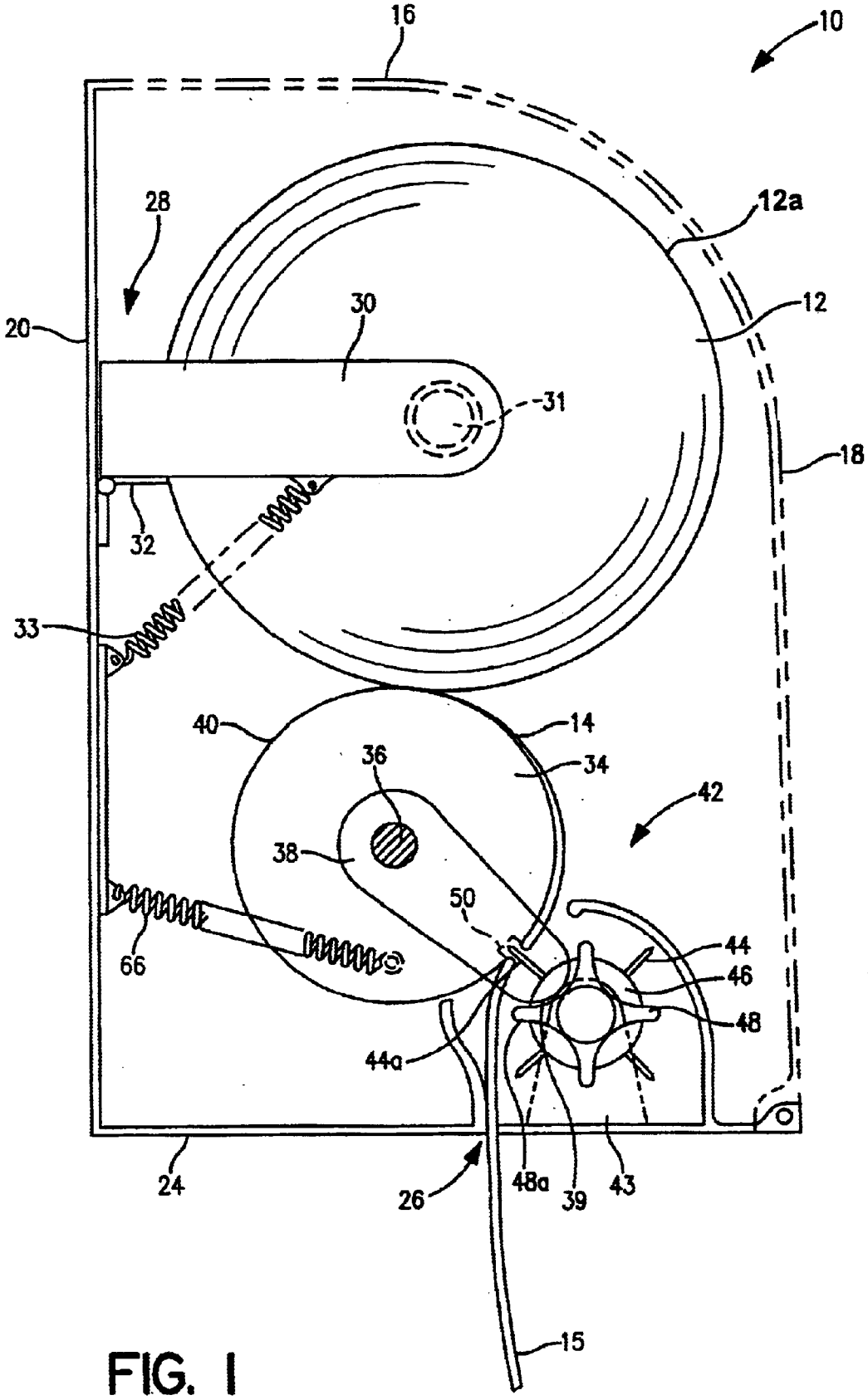
FIG. 1 is a side view of an embodiment of a dispenser according to the invention.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations.

The dispenser according to the invention is of the general type described in the Background Section of this application wherein a measured or metered length of the roll material is automatically dispensed and cut upon the consumer grasping and pulling on the tail end of the material. In this regard, many of the working components, particularly the automatic feed mechanism (typically an eccentric device), are well known to those skilled in the art and a detailed explanation thereof is not needed to explain and describe the relevant aspects of the present invention. For example, the present invention may incorporate the internal components (with the exception of the cutting mechanism) of the dispenser described in U.S. Pat. No. 4,621,755 to Granger. The '755 patent is thus incorporated herein by reference in its entirety for all purposes. The dispenser according to the invention may also incorporate the features of U.S. Pat. Nos. 4,635,837; 4,213,363; 4,846,035; and 4,122,738 all to Granger. All of these cited patents relate to mechanisms and components that may be used with the present invention. All of the patents cited above are thus incorporated herein in their entirety for all purposes.

An embodiment incorporating the basic features of a dispenser according to the present invention is indicated as a dispenser 10 in the figures. Dispenser 10 is configured to dispense a primary roll 12*a* of web material 12 that may comprise a standard eight-inch paper towel roll. Although not illustrated in the figures, the dispenser 10 may also carry and dispense a partially depleted or "stub" roll of material.

The dispenser 10 includes a housing 16 of any general shape and configuration. Housing 16 further comprises a bottom portion 24, a front portion 18, and a back portion 20. The dispenser is mounted to a supporting wall structure by any conventional means. The back portion 20 may have a generally rectangular shape and be configured to fit into a recess or opening provided in the supporting wall structure. A dispensing slot is defined at an appropriate location in the housing 16. In the illustrated embodiment, a dispensing slot 26 is provided generally in the middle of the bottom portion 24. It should be understood that the slot 26 may be disposed at various locations depending on the conveying path of the web material 12 and configuration of the internal components of the dispenser. The slot 26 is disposed so that the user can see and has easy access to the web material tail 15 extending through the slot 26.

It should be appreciated that the dispensing apparatus 10 according to the invention is not limited in its construction by any particular type of materials. For example, back portion 20 may comprise a sheet metal assembly and front portion 18 may comprise a removable or pivotal plastic assembly.

The roll of material 12 is carried by a primary roll carrier 28. In the illustrated embodiment, the roll carrier 28 has opposite arms 30 and roll supports 31 extending inward from the arms 30. The arms 30 may be biased, for example by a spring 32 or spring 33, towards a rotatable feed drum 34. The leading or free end of the web material 14 passes around at least a portion of the outer circumferential surface 40 of the feed drum 34 and eventually out through the dispensing slot 26. The rotatable drum 34 has a "roughened" (frictionally enhanced) outer circumferential surface 40 and is rotatable so that upon a consumer grasping and pulling the tail end of the web material extending out of the dispensing slot 26, the drum 34 is caused to rotate. In an alternate embodiment, the roll carrier need not be biased towards the feed drum 34 and an alternate arrangement of guides and/or tension rollers could be used to keep the web material under tension as it moves over at least a portion of the circumference of the drum 34.

A tensioned eccentric device is configured with the drum 34. In the illustrated embodiment, the eccentric device includes the offset mounted spring 66 such that energy is developed and stored in the spring 66 (illustrated schematically) upon the initial rotation of the drum 34. It should be understood that the spring 66 would be mounted so as not to interfere with rotation of the drum 34. For example, the drum may include an axle 36 mounted within a first support and the spring 66 may be attached to another member that rotates with the drum 34 beyond the end of axle 36 so that the spring does not "wrap" around the axle. Various arrangements of an eccentric device utilizing a spring to drive the drum 34 are disclosed in the patents cited above and incorporated herein.

As with the conventional dispensers, the drum 34 is relieved from the pulling tension after the web of material has been cut and continues to turn due to the action of the spring 66. The drum 34 will continue to rotate until it reaches a neutral or rest position. A "shock absorber" device may be provided to stop the return rotation of the feed drum 34 so that the drum is then in position for a subsequent pulling and cutting operation. A manual rotation knob (not illustrated) may be provided for manually advancing the drum 34 in the event of a jam or tear of the roll material within the housing 16.

The dispenser 10 includes a cutting mechanism, generally 42, to cut the web upon a user grasping and pulling the tail. The cutting mechanism 42 is movably mounted within the housing 16 external of the rotatable drum 34 and in relatively close proximity to the conveying path of the web material. The cutting mechanism is engaged by the drum 34 along a portion of the rotational arc thereof. Any member may be provided on or attached to the drum 34 to engage the cutting mechanism. For example, in the illustrated embodiment, a lever arm 38 is rotationally fixed at an end of the drum 34 relative to an axle 36. An arm 38 may be provided at each end of the drum 34. The lever arm 38 extends radially beyond the drum surface 40 such that its radial end engages and actuates the cutting mechanism, as described in greater detail below.

The cutting mechanism 42 is configured so that upon being engaged and moved by the drum 34, it moves to a cuffing position wherein a knife or blade 44 crosses the conveying path of the web material 14 and thus cuts the material. It should be appreciated that, in this regard, the cuffing mechanism may be composed of any manner of moveable components having a blade or knife 44 attached thereto. In the illustrated embodiment, the cutting mechanism 42 includes a roll 46 rotationally supported at its ends by supports 43. The roll 46 thus moves in a circular cutting path and includes at least one cutting blade 44 that crosses the conveying path of the web material 14 at a cutting position of the blade 44. Any manner of cam member, for example the cam arms 48, are configured with the roll 46 to be engaged by the lever arm 38 as the drum 34 rotates causing the blade 44 to move to its cutting position.

In the illustrated embodiment, the cutting position of any blade 44 is at a location on the circumference of the drum 34 where the web material passes over the drum, as illustrated in FIG. 1. The drum 34 includes a longitudinally extending groove 50 into which the blades move as the roll 46 rotates. As a blade moves into the groove 50, it crosses the conveying path of the web material and thus cuts the material. It should thus be appreciated that the relative rotational positions of the blades 44, cam arms 48, and groove 50 must be initially established to ensure that the blades 44 reach the cutting position at essentially the same time as the groove 50.

The cutting position of the blades 44 can be at virtually any location along the conveying path of the web material, and need not be on the circumference of the drum 34. For example, in an alternate embodiment the web material could be conveyed off of the surface of the drum 34 by any appropriate configuration of guides and tension rollers. The roll 46 and blades 44 could be appropriately sized and located so that the blades 44 are brought to a cutting position spaced from the drum surface 40.

In the illustrated embodiment, the roll 46 includes a plurality of blades 44 and cam arms 48 equally and alternately spaced around the circumference of the roll such that the lever arm 38 engages one of the cam arms 48 for each rotation of the rotatable drum 34. Thus, each of the cam arms 48 and an associated blade 44 is actuated in successive dispensing operations. The cam arms 48 and blades 44 are circumferentially spaced such that each of the cam members is engaged and disengaged by the lever arm 38 at generally the same rotational position of the rotational drum 34.

Figure 2:
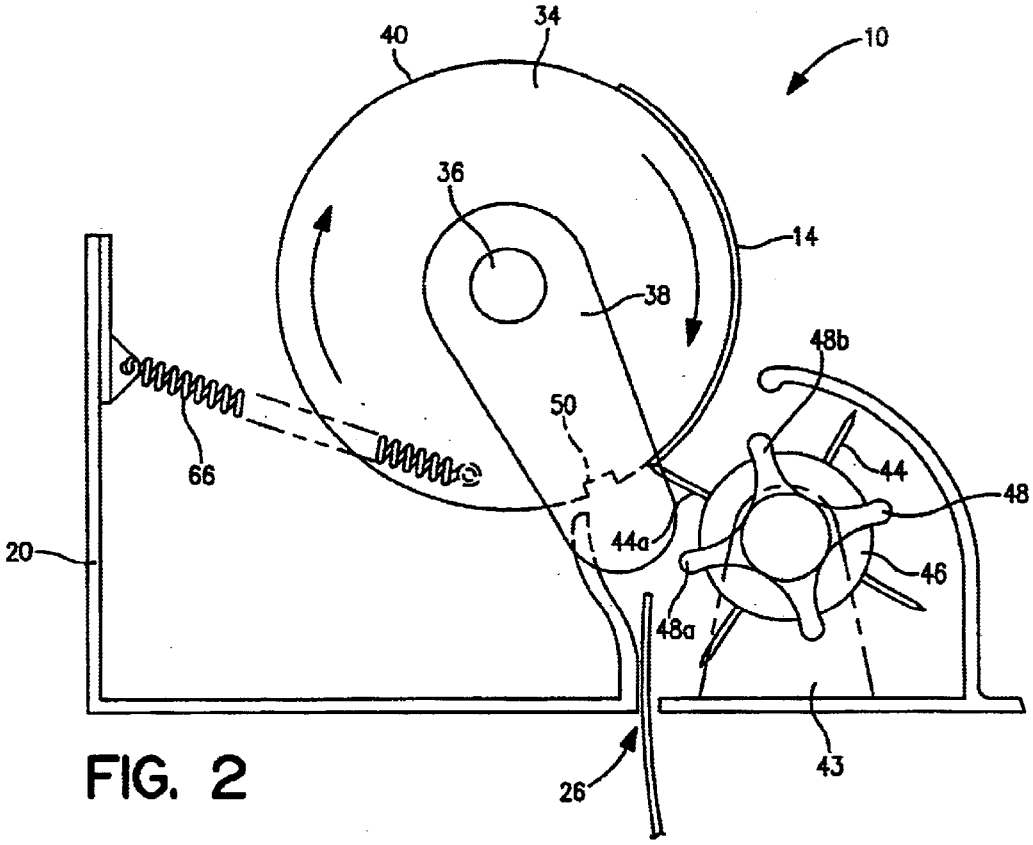
FIG. 2 is a side operational view of the cutting mechanism of the embodiment of FIG. 1.
Figure 3:
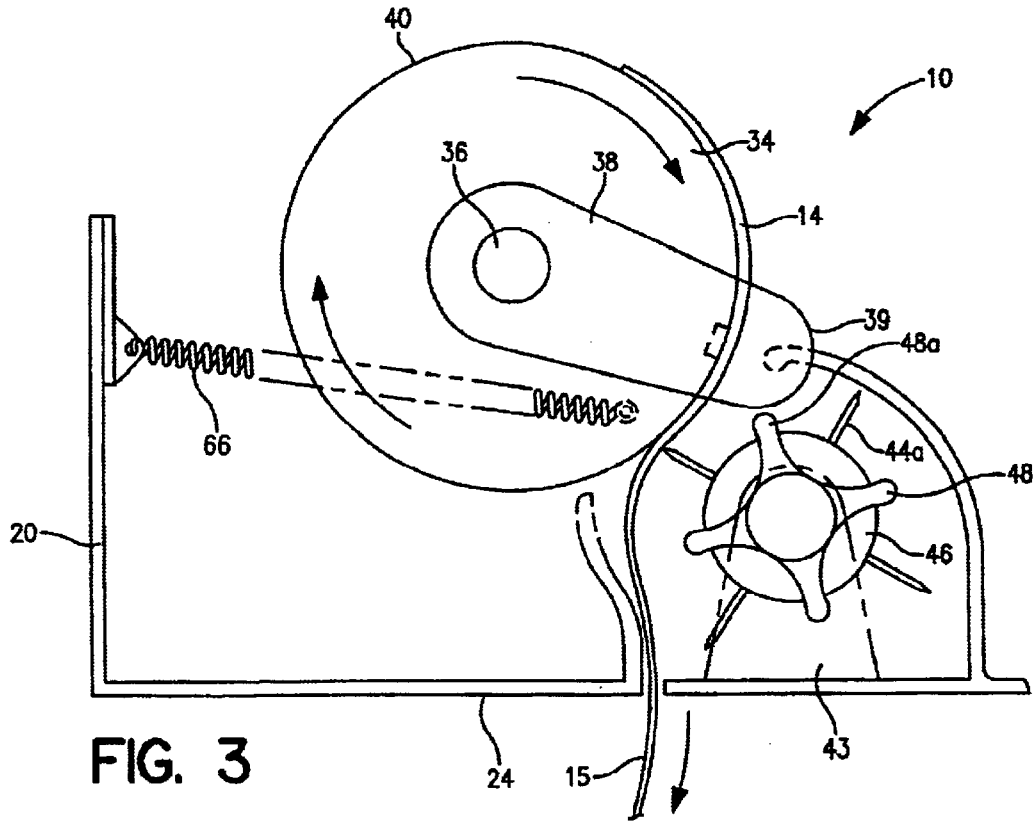
FIG. 3 is an additional side operational view of the cutting mechanism of the embodiment of FIG. 1.

FIG. 3 conceptually illustrates the drum 34 being rotated clockwise upon a user pulling the tail 15 of the web material 14. The drum has reached a rotational position such that the radial end 39 of the lever arm 38 comes into contact with cam arm 48*a* which is at its "rest" position. As the drum 34 rotates, engagement of the lever arm 38 with the cam arm 48*a* causes the roll 46 to rotate until the blade 44*a* moves to its cutting position as shown in FIG. 1 and cuts the web material 14 within the groove 50. Once the web material is cut, the drum 34 continues to rotate due to the influence of the eccentric spring 66 and the lever arm 38 eventually disengages from the cam arm 48*a,* as illustrated in FIG. 2. The drum will continue to rotate under the influence of the spring 66 until it reaches its rotational "rest" position. Once the lever arm 38 disengages from the cam arm 48*a,* the roll 46 stops rotating and the following cam arm 48*b* is in the "rest" position awaiting the next dispensing operation. A braking force or sufficient frictional resistance is supplied by the roll's bearing arrangement to ensure that the roll 46 does not continue to rotate upon being disengaged from the lever arm 38. The cutting mechanism operates this way for each successive dispensing operation.

It should be appreciated that the cutting mechanism 42 according to the invention may comprise various configurations of components without departing from the scope and spirit of the invention. For example, any manner of mechanical devices may be configured between the rotatable feed drum 34 and an externally mounted movable cutting blade to cause the blade to be moved to a cutting position at a desired time in the dispensing operation. It should thus be appreciated by those skilled in the art that various modifications and variations can be made in the present invention without departing from the scope or spirit of the invention. It is intended that the invention include such modifications and variations as come within the scope of the appended claims and their equivalents.

What is claimed is:

1. An apparatus for dispensing and cutting measured amounts from a roll of web material, said apparatus comprising:

a housing;

a roll carrier disposed within said housing to rotationally carry a roll of web material to be dispensed;

a rotatable drum disposed within said housing proximate to said roll carrier, said roll carrier biased towards said rotatable drum so that the roll of web material carried by said roll carrier is frictionally engaged against said drum thereby causing said drum to rotate upon a free end of the web material being pulled from said housing;

a rotatable cutting mechanism mounted within said housing external of and adjacent to said rotatable drum, said cutting mechanism including at least one cutting blade that moves across a conveying path of the web material as said cutting mechanism rotates to automatically cut the web material; and wherein said cutting mechanism is engaged and moved by said rotatable drum along a portion of a complete rotational arc of said rotatable drum causing said cutting mechanism to rotate and cut the web material, and said cutting mechanism is stationary and disengaged from said rotatable drum along a remaining portion of the complete rotational arc of said rotatable drum wherein said cutting mechanism rotates less than a full revolution per complete rotational arc of said rotatable drum.

2. The apparatus as in claim 1, wherein said rotatable drum comprises a radially extending lever arm, said lever arm engaging and moving said cutting mechanism along the portion of the rotational arc of said rotatable drum.

3. The apparatus as in claim 1, wherein said cutting mechanism comprises a roll generally parallel to said rotatable drum, said at least one cutting blade extending radially from said cutting mechanism roll.

4. The apparatus as in claim 3, wherein said rotatable drum comprises a longitudinally extending groove defined in a circumference thereof over which the web material passes, said cutting blade moving into said groove at a rotational cutting position of said cutting mechanism to cut the web material overlying said groove.

5. The apparatus as in claim 3, wherein said rotatable drum comprises a lever arm extending radially therefrom, said lever arm engaging and moving said cutting mechanism along the rotational arc portion of said rotatable drum.

6. The apparatus as in claim 3, further comprising a plurality of said cutting blades equally circumferentially spaced around said roll.

7. The apparatus as in claim 6, wherein said roll further comprises a plurality of circumferentially spaced cam members extending radially therefrom with at least one said cam member disposed between adjacent said cutting blades.

8. The apparatus as in claim 7, wherein said rotatable drum comprises a lever arm extending radially therefrom, said lever arm engaging one of said cam members for each rotation of said rotatable drum such that each of said cam members is engaged in successive operations of said apparatus.

9. The apparatus as in claim 8, wherein said cam members are circumferentially spaced such that each of said cam members is engaged and disengaged by said lever arm at generally a same rotational position of said rotatable drum.

10. The apparatus as in claim 1, wherein said rotatable drum is spring biased with a spring to a neutral position, said spring causing said rotatable drum to continue to rotate to said neutral position subsequent to cutting of the web material.

11. An apparatus for dispensing and cutting measured amounts from a roll of web material, said apparatus comprising:

a housing;

a roll carrier disposed within said housing to rotationally carry a roll of web material to be dispensed;

a rotatable drum disposed within said housing proximate to said roll carrier such that the web material runs around at least a portion of a circumference of said rotatable drum along a conveying path of the web material causing said rotatable drum to rotate upon a free end of the web material being pulled from said housing;

a cutting mechanism including at least one cutting blade movably mounted within said housing external of said rotatable drum, for each dispensing operation of said apparatus said cutting mechanism is engaged and moved by said rotatable drum along a portion of a complete rotational arc of said rotatable drum such that said cutting blade crosses the conveying path of the web material and cuts the web material, said cutting mechanism stationary and disengaged from said rotatable drum along a remaining portion of the complete rotational arc of said rotatable drum such that said cutting mechanism makes less than a full revolution per complete rotational arc of said rotatable drum.

12. The apparatus as in claim 11, wherein said cutting mechanism comprises a roll that rotates about a fixed axis, said cutting blade extending radially from said cutting mechanism roll.

13. The apparatus as in claim 12, wherein said cutting mechanism roll is engaged and moved by a radially extending member rotationally fixed to said rotatable drum.

14. The apparatus as in claim 13, further comprising a plurality of said cutting blades circumferentially spaced around said cutting mechanism roll and a plurality of radially extending cam members alternately spaced between said cutting blades.

15. The apparatus as in claim 14, wherein said cam members and said blades are circumferentially spaced such that said radially extending member engages and moves one said cam member and associated said blade for each rotation of said rotatable drum.

16. The apparatus as in claim 12, wherein said blade cuts the web material at a location on the circumference of said rotatable drum.

17. The apparatus as in claim 16, wherein said rotatable drum comprises a longitudinally extending groove defined in the circumference thereof, said blade moving into said groove to cut the web material.

18. The apparatus as in claim 11, wherein said rotatable drum is biased with a spring to a neutral position, said spring causing said rotatable drum to continue to rotate to said neutral position subsequent to cutting of the web material.

* * * * *